United States Patent [19]

Milford et al.

[11] Patent Number: 5,060,675

[45] Date of Patent: Oct. 29, 1991

[54] CIGARETTE AND PAPER WRAPPER THEREFOR

[75] Inventors: Ellen C. Milford, Clemmons; Hal E. Guess, Kernersville; Paul S. Chapman, Winston-Salem; Rebakah S. Dunn, Winston-Salem; Patricia F. Perfetti, Winston-Salem, all of N.C.

[73] Assignee: R. J. Reynolds Tobacco Company, Winston-Salem, N.C.

[21] Appl. No.: 475,635

[22] Filed: Feb. 6, 1990

[51] Int. Cl.[5] ..... A24D 1/02

[52] U.S. Cl. ..... 131/365

[58] Field of Search ..... 131/365

[56] References Cited

U.S. PATENT DOCUMENTS 3,106,210 10/1963 Reynolds et al. .
3,511,247 5/1970 Tamol .
3,526,904 9/1970 Tamol .
3,586,005 6/1971 Lipp et al. .
3,699,973 10/1972 Tamol et al. .
3,705,588 12/1972 Tamol et al. .
4,020,850 5/1977 Cogbill, II .
4,044,778 8/1977 Cohn .
4,129,134 12/1978 Hind et al. .
4,225,636 9/1980 Cline et al. .
4,236,532 12/1980 Schweizer et al. .
4,420,002 12/1983 Cline .
4,433,697 2/1984 Cline et al. .
4,450,847 5/1984 Owens .
4,505,282 3/1985 Cogbill et al. .
4,607,647 8/1986 Dashley et al. .
4,624,268 11/1986 Baker et al. .
4,679,575 7/1987 Yamaguchi et al. .
4,779,631 10/1988 Durocher et al. .
4,881,557 11/1989 Martin .
4,915,118 4/1990 Kaufman et al. .
4,942,888 7/1990 Montoya et al. .

*Primary Examiner*—V. Millin

[57] ABSTRACT

Cigarettes which yield low levels of visible sidestream smoke upon use employ a paper wrapping material having about 30 weight percent calcium carbonate and about 70 weight percent flax. The paper wrapper includes a coating or a film of polymeric material and an organic filler material. A preferred polymeric material is nitrocellulose, and a preferred inorganic filler material of the coating is particulate magnesium hydroxide. The coating weighs about 0.05 to about 0.5 pound per 3,000 square feet of wrapping material.

21 Claims, 1 Drawing Sheet

CIGARETTE AND PAPER WRAPPER THEREFOR

BACKGROUND OF THE INVENTION

The present invention relates to cigarettes, and in particular, to cigarettes which generate low amounts of visible sidestream smoke.

Popular smoking articles, such as cigarettes, have a substantially cylindrical rod shaped structure and include a charge of smokable material, such as shredded tobacco (e.g., cut filler), surrounded by a paper wrapper thereby forming a so-called "tobacco rod." It has become desirable to manufacture cigarettes having cylindrical filter elements aligned in an end-to-end relationship with the tobacco rod. Typically, a filter element is manufactured from cellulose acetate tow circumscribed by plug wrap, and is attached to the tobacco rod using a circumscribing tipping material. It also has become desirable to perforate the tipping material and plug wrap, in order to provide for dilution of drawn mainstream smoke with ambient air.

A cigarette is employed by the smoker by burning one end thereof. The smoker then receives mainstream smoke into his/her mouth by drawing on the opposite end (e.g., the filter end) of the cigarette. During the time that the cigarette is not being drawn upon by the smoker, it remains burning, and sidestream smoke is generated. Sidestream smoke is smoke which directly enters the atmosphere during the static burn period of a cigarette. Sidestream smoke diffuses into the atmosphere, and the characteristic visible nature thereof may be perceived negatively by certain individuals. Thus, certain cigarette smokers have indicated a desire to decrease the levels of visible sidestream smoke generated by their cigarette.

Cigarette paper wrappers for the preparation of tobacco rods are set forth in U.S. Pat. Nos. 4,231,377 to Cline et al, 4,420,002 to Cline, 4,461,311 to Mathews et al, 4,450,847 to Owens, and 4,805,644 to Hampl, Jr. et al, as well as European Patent Application Nos. 338,156 and 338,159. The paper wrappers proposed in the foregoing patents have a propensity to provide cigarettes which generate relatively low levels of visible sidestream smoke. Such wrappers typically (i) contain blends of inorganic fillers, (ii) contain relatively high levels of burn chemicals, (iii) exhibit fast burn rates, (iv) have a propensity to self-extinguish, (v) exhibit poor ashing characteristics, (vi) provide an undesirable off-taste, or (vii) involve fairly complex manufacturing procedures.

A cigarette which generates relatively low levels of visible sidestream smoke is set forth in European Patent Application No. 290,911. Another cigarette is described in U.S. Pat. No. 4,561,454 to Guess. However, cigarette paper wrappers which are useful for manufacturing cigarettes which generate low amounts of visible sidestream smoke upon use, particularly those wrappers which include magnesium hydroxide as a filler component, often have the propensity to provide, upon use, an ash having flaky properties.

It would be desirable to provide a cigarette which incorporates a paper wrapper such that upon use (i) the cigarette generates low levels of visible sidestream smoke, (ii) the cigarette provides good flavor and smoking satisfaction to the smoker thereof.

SUMMARY OF THE INVENTION

The present invention relates to cigarettes having a rod of smokable material contained in a circumscribing paper wrapper. Such a rod is referred to herein as a "smokable rod." The paper wrapper includes a cellulosic base web and a water insoluble inorganic filler. The preferred cellulosic material is flax fibers, and the preferred inorganic filler is calcium carbonate. The preferred paper wrapper includes a burn enhancer, such as a water soluble alkali metal salt. The paper wrapper also includes a coating or a film of polymeric material and an inorganic filler material. A preferred polymeric material is nitrocellulose, and a preferred inorganic filler material of the coating is particulate magnesium hydroxide.

Cigarettes of the present invention normally include a filter element positioned adjacent one end of the smokable rod, and tipping material circumscribing the filter element and an adjacent region of the smokable rod. Cigarettes having low efficiency and moderate efficiency cellulose acetate filter tow items are particularly preferred. The cigarettes preferably are air diluted.

Preferred cigarettes of the present invention, when employed, yield low levels of visible sidestream smoke as well as an ash which is cohesive and exhibits good integrity, and which is not highly flaky. In addition, the paper wrappers of preferred cigarettes of the present invention can provide for sidestream and mainstream smoke which does not possess a significant off-aroma or off-taste.

DETAILED DESCRIPTION OF THE PREFERRED EMBODIMENTS

Figure 1:
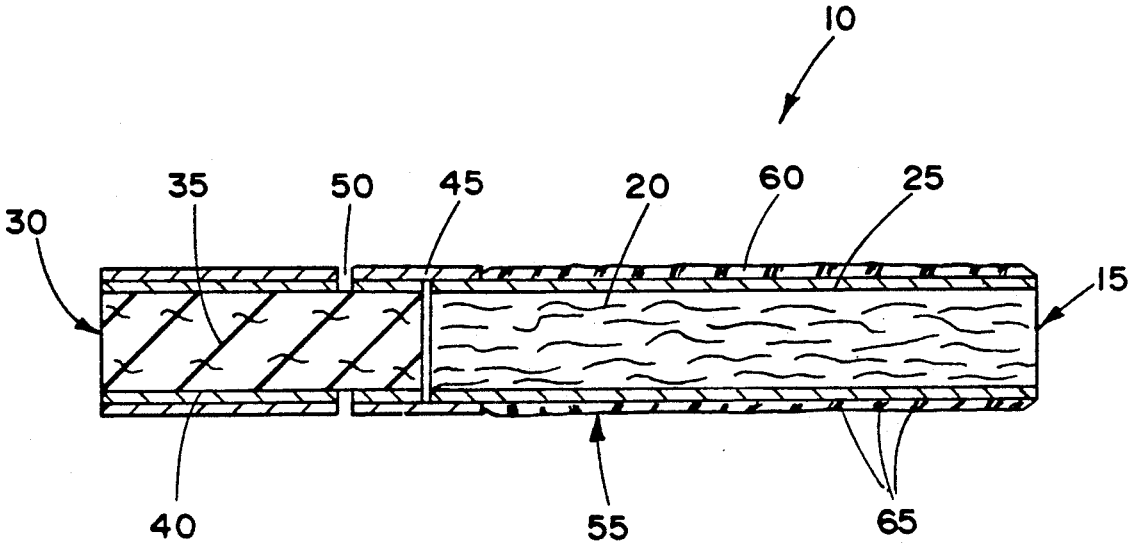
FIG. 1 is a longitudinal sectional view of a cigarette of the present invention.

One embodiment of a cigarette of the present invention is shown in FIG. 1. Cigarette 10 includes a generally cylindrical rod 15 of a charge or roll of smokable filler material 20 contained in circumscribing wrapping material 25. The rod 15 is conveniently referred to as a "smokable rod" or a "tobacco rod." The ends of the tobacco rod are open to expose the smokable filler material.

The cigarette 10 normally includes a filter element 30 or other suitable mouthpiece positioned adjacent one end of the tobacco rod 15 such that the filter element and tobacco rod are axially aligned in an end-to-end relationship, preferably abutting one another. Filter element 30 has a generally cylindrical shape, and the diameter thereof is essentially equal to the diameter of the tobacco rod. The ends of the filter element are open to permit the passage of air and smoke therethrough. The filter element 30 includes filter material 35 which is overwrapped along the longitudinally extending surface thereof with circumscribing plug wrap material 40. The filter element can have two or more filter segments, and/or flavor additives incorporated therein.

The filter element 30 is attached to the tobacco rod 15 by tipping material 45 which circumscribes both the entire length of the filter element and an adjacent region of the tobacco rod. The inner surface of the tipping material 45 is fixedly secured to the outer surface of the plug wrap 40 and the outer surface of the wrapping material 25 of the tobacco rod, using a suitable adhesive. A ventilated or air diluted smoking article is provided with an air dilution means, such as a series of perforations 50, each of which extend through the tipping material and plug wrap.

The wrapping material 25 has a width which is equal to the circumference of the cigarette plus the lap zone of the glue line which ultimately results during cigarette manufacture. The preferred wrapping material 25 includes a coating 55 on the outer surface of the wrapping material. The coating includes a polymeric film forming material 60 and an inorganic filler material 65. The coating 55 is shown as enlarged in FIG. 1.

Typically, the tobacco rod has a length which ranges from about 50 mm to about 85 mm, and a circumference of about 16 mm to about 28 mm. The tobacco rods and the resulting cigarettes can be manufactured in any known configuration using known cigarette making techniques and equipment.

Typically, the filter element has a length which ranges from about 20 mm to about 35 mm and a circumference of about 16 mm to about 28 mm. The filter material can be any suitable material such as cellulose acetate, polypropylene, tobacco material, or the like. Examples of suitable filter materials are cellulose acetate tow items having (i) about 3 denier per filament and about 35,000 total denier, and (ii) about 3.5 denier per filament and about 35,000 total denier. Such tow items conveniently provide filter elements exhibiting a removal efficiency of particulate matter from mainstream smoke of greater than about 40 weight percent. The plug wrap typically is a conventional paper plug wrap, and can be either air permeable or essentially air impermeable. However, if desired, a nonwrapped cellulose acetate filter element can be employed. Filter elements having two or more segments, and which are provided using known plug-tube-combining techniques, also can be employed. The various filter elements suitable for use in this invention can be manufactured using known cigarette filter making techniques and equipment.

Certain filter elements can provide minimal mainstream smoke removal efficiencies while maintaining the desirable draw characteristics of the cigarette. Such minimal smoke removal efficiencies are provided by the so-called "low efficiency" filters. Low efficiency filters have a minimal ability to remove mainstream smoke particulates. Generally, low efficiency filters provide about 40 weight percent mainstream smoke particulate removal efficiency or less. The low efficiency filter can be used in order that the relatively low "tar" yield is obtained primarily as a result of a relatively high level of filter ventilation or air dilution. Such cigarette configurations provide a means for reducing the yields of mainstream gaseous components. An example of a suitable material for providing a low efficiency filter element is a cellulose acetate tow item having about 8 denier per filament and about 40,000 total denier.

The filler material employed in the manufacture of the smokable rod can vary. The preferred filler material is an "American blend" of tobacco materials. For example, the filler can include a blend of flue-cured, Burley, Maryland, Oriental, reconstituted and volume expanded tobaccos. Other suitable blends are described in European Patent Application No. 290,911 and U.S. patent application Ser. No. 416,332, filed Sept. 29, 1989. The filler material also can include those types of smokable materials described in U.S. patent application Ser. Nos. 276,161, filed Nov. 23, 1988 and 414,833, filed Sept. 29, 1989.

The smokable materials generally are employed in the form of cut filler as is common in conventional cigarette manufacture. For example, the smokable filler material can be employed in the form of shreds or strands cut into widths ranging from about 1/10 inch to about 1/60 inch, preferably from about 1/20 inch to about 1/40 inch. Generally, such pieces have lengths which range from about 0.25 inch to about 3 inches.

As used herein, "packing density" means the weight of the filler material which occupies a unit volume within the smokable rod. For articles of this invention, the packing density generally ranges from about 100 $mg/cm^3$ to about 300 $mg/cm^3$, more typically from about 150 $mg/cm^3$ to about 275 $mg/cm^3$.

Flavorants can be incorporated into the cigarettes. For example, the filler materials can be employed with casing or top dressing additives. See, for example, Leffingwell et al, *Tobacco Flavoring for Smoking Products* (1972). Flavorants such as menthol can be incorporated into the cigarette using techniques familiar to the skilled artisan. If desired, flavor additives such as organic acids can be incorporated into the cigarette as additives to the cut filler. In particular, levulinic acid, nicotine levulinate, or a mixture of levulinic acid and nicotine can be incorporated into the cigarette. For example, the levulinic acid, nicotine levulinate or levulinic acid/nicotine mixture can be added to the cut filler in amounts which typically range from about 1 to about 10 percent, based on the weight of the cut filler. See, U.S. Pat. No. 4,830,028 to Lawson et al.

Typically, the tipping material circumscribes the filter element and an adjacent region of the tobacco rod such that the tipping material extends about 3 mm to about 6 mm along the length of the tobacco rod. Typically, the tipping material is a conventional paper tipping material. The tipping material can have a porosity which can vary. For example, the tipping material can be essentially air impermeable, air permeable, or be treated (e.g., by mechanical or laser perforation techniques) so as to have a region of perforations, openings or vents thereby providing a means for providing air dilution to the cigarette. The total surface area of the perforations and the positioning of the perforations along the periphery of the cigarette can be varied in order to control the performance characteristics of the cigarette.

For certain cigarettes of the present invention, the air dilution means can be positioned along the length of the cigarette at a point along the filter element which is at a maximum distance from the extreme mouthend thereof. The maximum distance is dictated by factors such as manufacturing constraints associated with the type of tipping employed and the cigarette manufacturing apparatus and process. For example, for a filter element having a 27 mm length, the maximum distance may range from about 23 mm to about 26 mm from the extreme mouthend of the filter element. The positioning of the air dilution vents a maximum distance from the extreme mouthend of certain cigarettes allows for providing a maximum ventilation level for a given "tar" yield and maximum cigarette pressure drop for a given filter element and tobacco rod combination.

As used herein, the term "air dilution" is the ratio (generally expressed as a percentage) of the volume of air drawn through the air dilution means to the total volume of air and smoke drawn through the cigarette and exiting the extreme mouthend portion of the cigarette. For air diluted or ventilated cigarettes of the present invention, the amount of air dilution can vary. Generally, the amount of air dilution for a cigarette is greater than about 10 percent, often greater than about 20 percent, and frequently greater than about 30 percent. Typically, for cigarettes of relatively small circumference (i.e., about 21 mm or less) the air dilution can be somewhat less than that of cigarettes of larger circumference. The upper limit of air dilution for a cigarette typically is less than about 75 percent, more frequently less than about 70 percent.

As used herein, the term "pressure drop" in referring to the cigarette is meant that difference between atmospheric pressure at the extreme mouthend point of the cigarette, as measured at a given flow rate through the cigarette. Typical pressure drop values for cigarettes of the present invention are greater than about 50 mm, more frequently greater than about 80 mm of water pressure drop at 17.5 ml/sec of air flow rate.

Although the basis weights of the wrapping materials for the tobacco rod can vary, preferred wrapping materials often have relatively low basis weights. Typical basis weights for such wrapping materials can be as low as about 20 $g/m^2$, generally are about 25 $g/m^2$ or more, and sometimes are about 35 $g/m^2$ or more. Typical basis weights do not exceed about 80 $g/m^2$.

Wrapping materials for the tobacco rod can have a wide range of permeabilities or porosities. Typical wrapping materials have inherent permeabilities which range from about 5 CORESTA units to about 75 CORESTA units, and preferably average about 30 CORESTA units. Although not preferred, wrapping materials can be electrostatically perforated.

Typical wrapping materials are paper wrapping materials which contain about 55 to about 95, preferably about 65 to about 90 weight percent cellulosic material; and about 5 to about 45, preferably about 10 to about 35 weight percent inorganic filler. The preferred inorganic filler is calcium carbonate, although other fillers and combinations of other fillers with calcium carbonate can be employed. Preferred paper wrapping materials contain up to about 45 percent, more preferably up to about 35 percent, and most preferably about 25 to about 35 percent, by weight of calcium carbonate. The inorganic filler provides a desired opacity to the paper. The preferred papers also contain flax fibers, wood pulp, esparto fiber, sisal fibers, or other cellulosic material to provide a cellulosic base web. Mixtures of 2 or more types of cellulosic materials can be employed. The selection of inorganic fillers and cellulosic materials for the manufacture of smokable rod wrapping materials will be apparent to the skilled artisan.

Highly preferred wrapping materials incorporate at least one burn enhancer or ash conditioner therein. Examples of burn enhancers include water soluble alkali metal salts such as sodium and potassium salts of citric acid, hydrochloric acid, carbonic acid, acetic acid, malic acid, succinic acid, tartaric acid, hydrochloric acid, nitric acid, propionic acid, carbonic acid, fumaric acid and glycolic acid. However, other burn enhancers can be employed. Typically, the burn enhancer or ash conditioner is incorporated into the wrapping material in an amount up to about 15 percent, generally up to about 12 percent, and frequently up to about 6 percent, based on the dry weight of the base wrapping material. In addition, the burn enhancer typically is incorporated into the wrapping material in an amount greater than about 0.25 percent, generally greater than about 1 percent, and frequently greater than about 3 percent, based on the dry weight of the base wrapping material. For many wrapping materials, the amount of burn enhancer incorporated therein ranges from about 0.3 to about 3 percent, based on the dry weight of the base wrapping material.

The manner in which burn enhancer or ash conditioner is incorporated into the paper wrap can vary. The burn enhancer can be incorporated into the paper during the manufacturing process. Alternatively, the burn enhancer can be incorporated into the paper using size press techniques, painting techniques, rotogravure techniques, or the like. Such techniques will be apparent to the skilled artisan. It is highly preferred that the burn enhancer be incorporated into the paper in an essentially uniform manner throughout the paper. Various burn enhancers can be incorporated into the paper simultaneously, or at different processing stages during or after paper manufacture.

The wrapping material of the smokable rod is coated with a coating or film which includes an inorganic filler. Examples of inorganic fillers are magnesium hydroxide, magnesium oxide, magnesium sulfate, magnesium carbonate, calcium sulfate and calcium carbonate. Combinations of two or more inorganic fillers can be employed. The inorganic filler is employed in the form of particles, normally in the range of about 0.3 micron to about 3 microns in diameter. Typically, the inorganic filler particles are fairly small, in order that an aesthetically pleasing (i.e., a non-grainy) surface is provided to the wrapping material. Preferred inorganic fillers provide an intumescent character to the wrapping material to which that filler is applied.

The wrapping material of the smokable rod is coated with a coating or film which includes a polymeric material. The preferred polymeric material has film-forming capabilities so as to form a coating or film over the surface of the wrapping material to which it is applied, and bind or otherwise hold the inorganic filler of the coating in place. Examples of polymeric materials include nitrocellulose, hydroxypropylcellulose, methylcellulose, carboxymethylcellulose and polyvinylacetate. If desired, specific polymeric materials can be employed in conjunction with suitable plasticizers (e.g., nitrocellulose can be employed in conjunction with dibutyl phthalate). The polymeric material can be soluble in an aqueous solvent or other solvents (e.g., ethylacetate, isopropylacetate or ethanol). Preferably, the polymeric material has a relatively low molecular weight in order to ensure easy application thereof to the wrapping material.

The manner in which the polymeric material and inorganic filler are applied to the wrapping material can vary. Normally, the polymeric material is dispersed in a suitable solvent along with the inorganic filler, so as to provide a mixture which can be applied to a surface of the wrapping material using known techniques. For example, the mixture can be painted onto a surface of the wrapping material or applied to a surface of the wrapping material using gravure coating techniques. Other techniques for applying the mixture to the wrapping material include blade coating techniques, air-knife coating techniques, roll coating techniques and shaft coating techniques. Typically, the mixture which is applied to the wrapping material includes about 80 to about 99, preferably about 85 to about 95 percent solvent, based on the total weight of the mixture. The mixture can be applied only to that surface of the wrapping material which ultimately is the outer surface of the wrapping material for cigarette manufacture, only to that surface of the wrapping material which ultimately is the inner surface of the wrapping material for cigarette manufacture, or to both of the surfaces of the wrapping material. After the dispersion is applied to the wrapping material, a substantial portion of the solvent is removed therefrom (e.g., by evaporation or other drying techniques).

The configuration of the coating on the wrapping material can vary. The coating can be applied to a surface of the wrapping material so as to fully cover that surface or provide a pattern on that surface. One type of pattern includes a plurality of printed squares about 4 $mm^2$ in area positioned about 1 mm apart. Another pattern includes a grid of plurality of 1 mm wide lines positioned about 2 mm apart and crossing at right angles to one another. Another pattern is a honeycomb pattern provided by a plurality of printed hexagons about 2 mm in diagonal dimension positioned about 0.5 mm apart. If desired, more than one coating can be applied to a surface of the wrapping material. For example, a surface of the wrapping material can be coated with a mixture of polymeric material within a solvent so as to provide a surface fully covered by a film of the polymeric material, and then that surface can be coated with a second mixture of polymeric material and inorganic filler within a solvent so as to provide a surface having a second film including both the polymeric material and the inorganic material. As another example, a surface of the wrapping material can be coated to fully cover that surface, and then coated to provide a pattern. As yet another example, a surface of the wrapping material can be coated to provide a pattern, and then coated to fully cover the surface. It is highly preferred that a substantial amount of the solvent be removed from the surface of the wrapping material prior to the time that the second coating is applied.

The amount of polymeric material relative to the amount of filler material within the coating can vary. Preferably, the amount of the particular polymeric material employed is sufficient to adequately bind the inorganic filler to the wrapping material. Normally, not more than 75 weight percent, frequently about 30 to about 70 weight percent, of the coating is provided by the inorganic material filler material.

The amount of polymeric material and inorganic applied to the surface of the wrapping material can vary. Typical coatings weigh about 0.05 to about 0.5, preferably about 0.1 to about 0.3 pounds per 3,000 square feet of wrapping material.

Coated paper wrapping materials of the present invention can be manufactured in a relatively simple manner. As such, it is possible to provide papers incorporating two or more filler materials without the necessity of manufacturing unique papers. Preferred papers, which have the coating applied to the "felt side" thereof, tend to exhibit a "two-sided" character. In addition, the presence of inorganic filler within the coating provides for a further decrease in the porosity of the wrapping material. The coated wrapping materials can be electrostatically perforated (e.g., to provide a net porosity above about 15 CORESTA units).

Preferred cigarettes of the present invention produce low levels of visible sidestream smoke. The visible sidestream smoke emitted by of cigarettes of the present invention frequently can be as much as about 40 percent of that of conventional cigarettes of comparable FTC "tar" delivery and configuration. By the term "configuration" in referring to a cigarette is meant the circumference, tobacco rod length and filter element length. Cigarettes of the present invention also can generate relatively low levels of sidestream "tar" when evaluated using the technique described by Proctor et al, *Analyst*, Vol. 113, p. 1509 (1988).

The following examples are provided in order to further illustrate the invention but should not be construed as limiting the scope thereof. Unless otherwise noted, all parts and percentages are by weight.

EXAMPLE 1

Cigarettes having lengths of about 99 mm and circumferences of about 24.85 mm have tobacco rod lengths of about 68 mm and filter element lengths of about 31 mm. The tobacco rod includes a charge of tobacco cut filler contained in a circumscribing cigarette paper wrapper. The filler material employed in providing the tobacco rod is in the form of strands cut at about 32 cuts per inch. The filler material includes a blend of about 77 percent volume expanded flue-cured tobacco cut filler about 17 percent Oriental tobacco cut filler, and about 6 percent Maryland tobacco cut filler.

The paper wrapper is a low visible sidestream paper. The base sheet contains about 18 percent calcium carbonate and about 82 percent flax fiber. The paper has an inherent permeability of 5 CORESTA units and a basis weight of about 25 $g/m^2$. A burn enhancer in the form of potassium acetate is applied to the paper using a size press technique. The paper includes about 18 mg potassium ions per gram of dry base sheet.

About 89.3 parts isopropylacetate are mixed with 2.9 parts nitrocellulose, 1.6 parts dibutyl phthalate and 6.2 parts particulate magnesium hydroxide. The resulting mixture is applied to the "felt side" of the paper wrapper moving at a rate of about 1,000 feet per minute using a gravure technique at ambient temperature so as to fully cover the surface of the paper wrapper. The paper having the mixture applied thereto is subjected to heat treatment step at about 200° F. for less than 2 seconds in order to evaporate substantially all of the isopropylacetate from the paper, and provide a coating of polymeric material and inorganic filler to one side of the paper. About 0.3 lb. of nitrocellulose, dibutyl phthalate and magnesium hydroxide is applied as a coating to 3,000 square feet of paper. The coated paper has an inherent porosity of less than 1 CORESTA unit.

The filter element is manufactured using conventional cigarette filter making technology from a moderate efficiency cellulose acetate tow item (8 denier per filament, 40,000 total denier) and circumscribing air impermeable paper plug wrap. Such a filter element provides for less than 40 percent removal efficiency of particulate matter from the mainstream tobacco smoke of the cigarette.

The tobacco rod and filter element have similar circumferences, are aligned in an abutting, end-to-end relationship, and are secured together using tipping paper. The tipping paper is adhesively secured to the filter element and the adjacent portion of the tobacco rod. The tipping material circumscribes the length of the filter element and about 4 mm of the length of the tobacco rod. Cigarettes so described are manufactured using a Hauni Protos Cigarette Maker from Hauni-Werke Korber & Co. KG. The coating on the paper wrapper faces the outside of the cigarette.

The cigarette weighs about 0.881 g and the filler material within the rod has a packing density of about 0.168 mg/cm$^3$.

The cigarette is smoked and delivers tobacco smoke flavor as well as an acceptable draft resistance. The mainstream smoke is not harsh and the cigarette yields desirable smoking satisfaction. Also, the cigarette yields low amounts of visible sidestream smoke.

The cigarette exhibits less staining of the paper wrapper of the tobacco rod during smoking than a comparable cigarette not having the coating applied to the outer surface of the paper wrapper of the tobacco rod.

EXAMPLE 2

Cigarettes having lengths of about 84 mm and circumferences of about 24.85 mm have tobacco rod lengths of about 57 mm and filter element lengths of about 27 mm. The tobacco rod includes a charge of tobacco cut filler contained in a circumscribing cigarette paper wrapper. The filler material employed in providing the tobacco rod is in the form of strands cut at about 32 cuts per inch. The filler material employed is described in Example 1.

The paper wrapper is available as Reference No. 856 from Ecusta Corp. The base sheet contains about 28 percent calcium carbonate and about 72 percent flax fiber. The paper has an inherent permeability of 24 CORESTA units and a basis weight of about 25 g/m$^2$. A burn enhancer in the form of a mixture of sodium and potassium citrates is applied to the paper.

About 89.3 parts isopropylacetate are mixed with 2.9 parts nitrocellulose, 1.6 parts dibutyl phthalate and 6.2 parts particulate magnesium hydroxide. The resulting mixture is applied to the "felt side" of the paper wrapper moving at a rate of about 250 feet per minute using a gravure technique at ambient temperature so as to fully cover the surface of the paper wrapper. The paper having the mixture applied thereto is subjected to heat treatment step at about 120° F. for about 5 seconds in order to evaporate substantially all of the isopropylacetate from the paper, and provide a coating of polymeric material and inorganic filler to one side of the paper. About 0.3 lb. of nitrocellulose, dibutyl phthalate and magnesium hydroxide is applied as a coating to 3,000 square feet of paper. The coated paper has an inherent porosity of about 5 CORESTA units.

The filter element is manufactured using conventional cigarette filter making technology from a low efficiency cellulose acetate tow item (8 denier per filament, 40,000 total denier) and circumscribing air impermeable paper plug wrap. Such a filter element provides for less than 40 percent removal efficiency of particulate matter from the mainstream tobacco smoke of the cigarette.

The tobacco rod and filter element have similar circumferences, are aligned in an abutting, end-to-end relationship, and are secured together using tipping paper. The tipping paper is adhesively secured to the filter element and the adjacent portion of the tobacco rod. The tipping material circumscribes the length of the filter element and about 4 mm of the length of the tobacco rod. Cigarettes so described are manufactured using a Hauni Protos Cigarette Maker from Hauni-Werke Korber & Co. KG. The coating on the paper wrapper faces the outside of the cigarette.

The cigarette is smoked and delivers tobacco smoke flavor as well as an acceptable draft resistance. The mainstream smoke is not harsh and the cigarette yields desirable smoking satisfaction. Also, the cigarette yields low amounts of visible sidestream smoke relative to a comparable cigarette not having the coating applied to the paper wrapper of the tobacco rod.

The cigarette exhibits less staining of the paper wrapper of the tobacco rod during smoking than a comparable cigarette not having the coating applied to the outer surface of the paper wrapper of the tobacco rod.

EXAMPLE 3

A cigarette having the configuration, dimensions and components described in Example 2 is provided, except that the paper wrapper of the tobacco rod has a basis weight of about 35 g/m$^2$ and an inherent permeability of about 10 CORESTA units. The paper wrapper of the tobacco rod is coated with a mixture of nitrocellulose, dibutyl phthalate and particulate magnesium hydroxide, as described in Example 2The coated paper has an inherent porosity of about 5 CORESTA units.

EXAMPLE 4

The components described in Example 2 are employed to provide cigarettes having lengths of 99 mm (i.e., filter element lengths of 31 mm and tobacco rod lengths of 68 mm). The paper wrapper of the tobacco rod is coated, as described in Example 2. The cigarette is manufactured such that the coating on the paper wrapper faces the inside of the cigarette.

EXAMPLE 5

The components described in Example 3 are employed to provide cigarettes having lengths of 99 mm (i.e., filter element lengths of 31 mm and tobacco rod lengths of 68 mm). The paper wrapper of the tobacco rod is coated, as described in Example 3. The cigarette is manufactured such that the coating on the paper wrapper faces the inside of the cigarette.

We claim:

1. A cigarette comprising a rod of smokable material contained in a circumscribing paper wrapping material thereby forming a smokable rod; the wrapping material (i) having a cellulosic base web containing inorganic filler, and (ii) having a coating of a polymeric material and an inorganic filler material, the coating weighing about 0.05 to about 0.5 pound per 3,000 square feet of wrapping material.

2. The cigarette of claim 1 wherein the wrapping material of the smokable rod includes a burn enhancer.

3. The cigarette of claim 1 or 2 wherein the coating includes nitrocellulose and magnesium hydroxide.

4. The cigarette of claim 2 wherein the burn enhancer includes a water soluble alkali metal salt.

5. The cigarette of claim 1 wherein the coating includes about 30 to about 70 weight percent inorganic filler material, based on the total weight of the coating.

6. The cigarette of claim 3 wherein the coating includes about 30 to about 70 weight percent inorganic filler material, based on the total weight of the coating.

7. The cigarette of claim 1 including a filter element positioned adjacent one end of the tobacco rod, and tipping material circumscribing the filter element and an adjacent region of the tobacco rod.

8. The cigarette of claim 1 wherein the wrapping material has an inherent porosity of less than 1 CORESTA unit.

9. The cigarette of claim 3 wherein the wrapping material has an inherent porosity of less than 1 CORESTA unit.

10. The cigarette of claim 1 wherein the coating weighs about 0.1 to about 0.3 pound per 3,000 square feet of wrapping material.

11. The cigarette of claim 3 wherein the coating weighs about 0.1 to about 0.3 pound per 3,000 square feet of wrapping material.

12. The cigarette of claim 1 wherein the coating fully covers the wrapping material.

13. The cigarette of claim 1 wherein the coating provides a pattern on the wrapping material.

14. The cigarette of calim 1 wherein the wrapping material includes an inner surface and an outer surface, and the outer surface has the coating applied thereto.

15. The cigarette of claim 3 wherein the wrapping material includes an inner surface and an outer surface, and the outer surface has the coating applied thereto.

16. The cigarette of claim 1 wherein the wrapping material includes an inner surface and an outer surface, and the inner surface has the coating applied thereto.

17. The cigarette of claim 3 wherein the wrapping material includes an inner surface and an outer surface, and the inner surface has the coating applied thereto.

18. The cigarette of claim 1 wherein the wrapping material has a net porosity above about 15 CORESTA units.

19. The cigarette of calim 1 wherein the inorganic filler material of the coating has the form of particles about 0.3 micron to about 3 in diameter.

20. The cigarette of claim 1 wherein the inorganic filler of the wrapping material includes calcium carbonate and the inorganic filler material of the coating includes magnesium hydroxide.

21. The cigarette of claim 2 wherein the wrapping material includes about 0.3 to about 3 percent burn enhancer, based on the dry weight of base wrapping material.

* * * * *